United States Patent [19]

Kaim et al.

[11] Patent Number: 5,000,330

[45] Date of Patent: Mar. 19, 1991

[54] RAILWAY VEHICLE ROTARY DRAWBAR ARRANGEMENT

[75] Inventors: John W. Kaim, Chicago, Ill.; Russell G. Altherr, Munster, Ind.; Horst T. Kaufhold, Chicago, Ill.

[73] Assignee: AMSTED Industries Incorporated, Chicago, Ill.

[21] Appl. No.: 428,063

[22] Filed: Oct. 27, 1989

[51] Int. Cl.[5] ..... B61G 9/00

[52] U.S. Cl. ..... 213/62 R; 213/61; 213/74

[58] Field of Search ..... 213/50, 56, 58, 61, 213/62 R, 62 A, 74

[56] References Cited

U.S. PATENT DOCUMENTS

| | | | |
|---|---|---|---|
| 3,716,146 | 2/1973 | Altherr | 213/75 R |
| 4,456,133 | 6/1984 | Altherr et al. | 213/62 R |
| 4,549,606 | 11/1985 | Altherr et al. | 213/62 A |
| 4,580,686 | 4/1986 | Elliott | 213/62 A |
| 4,593,827 | 6/1986 | Altherr | 213/56 |
| 4,700,853 | 10/1987 | Altherr et al. | 213/50 |
| 4,700,854 | 10/1987 | Chadwick | 213/62 R |

*Primary Examiner*—Robert P. Olszewski
*Assistant Examiner*—S. Joseph Morano
*Attorney, Agent, or Firm*—Charles E. Bouton; Edward J. Brosius

[57] ABSTRACT

A railway vehicle drawbar slackless rotary dump arrangement having one end fixed against rotation to one railway vehicle and the other end connected to be rotatable in a second adjoining railway vehicle. Slack elimination is provided by a wedge at each connection. The rotatable connection includes a drawbar ball end held between concentric pulling blocks and follower block with a shim and cradle arrangement to maintain alignment of the concentric parts. Appurtenances are provided to the drawbar shank to simulate striker castings and interlocked E and F type couplers so as to accommodate the drawbar for use with indexing apparatus at the unloading site. Means are also incorporated to move cars in case of failure of system components.

22 Claims, 6 Drawing Sheets

RAILWAY VEHICLE ROTARY DRAWBAR ARRANGEMENT

FIELD OF INVENTION

The present invention relates to railway vehicle coupling devices and more particularly to a new and improved slackless rotary dump drawbar structure and system.

BACKGROUND OF INVENTION

Drawbars are used in integral or unit trains to permanently connect rail cars together. The drawbars replace the conventional E and F couplers used heretofore to detachably couple the cars. Preferably the drawbar connections are made slackless, as by gravity wedges, so as to minimize impact forces.

Drawbars are used in transporting unit trains for bulk commodities, such as ore, taconite, coal, grain, phosphate and the like. Rotary drawbars permit commodities to be discharged or emptied by rotating each car individually while still permanently connected to an adjacent car. The connecting structure is incorporated in the cars as a slackless drawbar having a rotary connection at one end of one car and a fixed or non-rotatable connection at the opposite end. However, where the rotary slackless connection includes a gravity wedge, car rotation may displace the wedge.

As explained above, the loaded cars of the trains may be individually rotated and emptied at an unloading or discharge station. In the unloading procedure, the cars are spotted or located at the entrance to the discharge station. To this end there is provided an on site car indexer or positioner system which serves to move the train and sequentially spot or individually index each car into the discharge station.

The car positioner system includes a power driven carriage which travels on a runway parallel and adjacent to the railway track on which the unit train to be unloaded is located. A pusher arm is mounted on the carriage and is movable to a position for engagement with the car coupling devices located between the cars for moving the cars into a discharge station.

Pusher arm heads on the positioner systems currently in use are designed for use with railcars interconnected with articulated couplers by either engaging both coupler heads at the coupled connection or engaging a striker casting fixed to the end of the center sill of one car from which a coupler extends.

In one type the pusher arm head is designed to embrace or encompass the coupled heads about the knuckle and guard arm sides of E or F couplers to move the railway cars. Another design utilizes the pusher arm head to interengage between the striker casting and the E or F coupler heads extending therefrom to move and position the car into the dumping or unloading station.

Both of these pusher arm designs require structural features peculiar to the E and F coupler heads which features normally are not present on the shank of a drawbar. Moreover striker castings are not required when a drawbar connects two railcars and recent railway car design for drawbar connection has eliminated the striker casting to reduce the car weight.

The slackless rotary dump drawbar structure as heretofore mentioned may be permanently connected between railway cars. Examples of slackless drawbar systems, including car connections, are illustrated in U.S. Pat. No. 4,456,133. As shown and described the slackless drawbar system is constructed in a manner to provide zero slack to eliminate impact forces which occur during run-in and run-out of slack. Essentially the slackless construction includes a wedge located so as to drop by gravity to occupy the space caused by any longitudinal wear which may occur at the connected ends of the drawbar. Ultimately, the wedge, drawbar and associated component surfaces may wear to such an extent such that the wedge does not take up the slack and the connections must be adjusted to regain the slackless relationship.

SUMMARY OF THE PRESENT INVENTION

In accordance with the present invention it is proposed to provide a slackless rotary dump drawbar system construction which minimizes the wear to the railway car connections and in the event wear occurs, renewal to as close as new condition may be accomplished with relative ease.

The present drawbar system also maintains proper orientation and alignment of the rotatable drawbar-end and car-end parts.

The drawbar is further constructed so as to be capable of being used with existing car positioners having indexer means designed for use with interlocked E and/or F coupler heads to move the train and also for use with indexer means designed to use striker castings for movement of the train.

Briefly, the slackless rotary dump drawbar system of the present invention comprises a shank having one end non-rotatably or fixedly connectable within a pocket of a center sill of one car and rotatably connected within a pocket of a center sill of an adjoining car. The rotatably connected end is formed as a ball shaped configuration and is positioned within the pocket between pulling blocks, which bear against a front stop and are formed with part-spherical concave surfaces that embrace and retain one side of the ball configuration end of the drawbar against pulling loads, and a concave bearing block that abuts the ball configuration to receive buff loads. The part spherical pulling block surface is reduced at one portion of the bearing area to lessen interference conditions and the like. Means are also provided at the rotatable connection to maintain proper alignment of the pulling blocks, ball configuration and bearing block. The drawbar fixed end is keyed to the center sill of the adjacent car.

The rotatable and fixed ends of the drawbar are maintained slackless in the respective center sill pockets in a manner that the drawbar need not be removed when the wedge becomes incapable of taking up the slack. This is accomplished by providing the wedge with lifting and positioning structure and providing access openings in the drawbar pocket castings and center sill to facilitate handling of the wedges. The drawbar is also constructed to provide surfaces extending therefrom to simulate those surfaces associated with standard coupler construction and structure to accommodate indexer arrangements using such structure for moving the railway cars to an unloading station.

Slots are provided for draft keys to secure AAR STD "E" type couplers to move each car individually or coupled to another car for transport to the nearest repair point.

Further features of the invention will be apparent from the following specification.

DESCRIPTION OF THE PREFERRED EMBODIMENT

Figure 1:
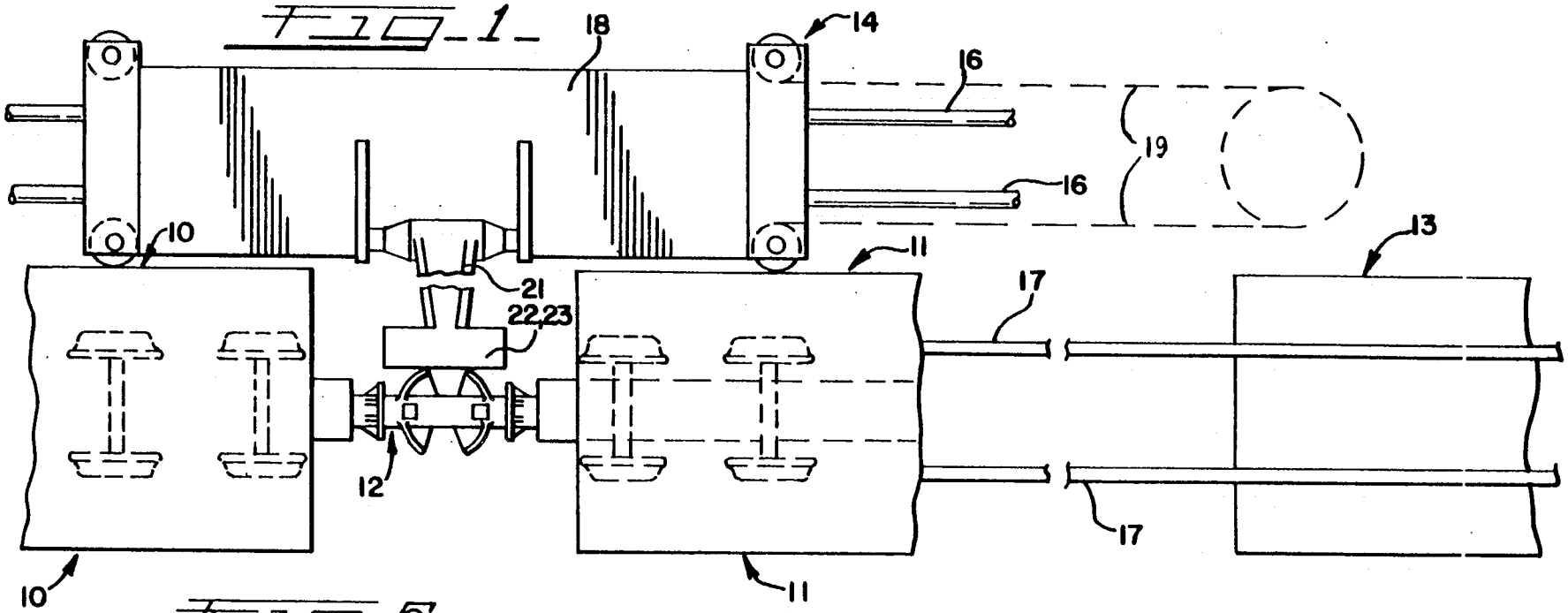
FIG. 1 is a schematic top plan view of a positioner arrangement for unloading cars shown with railway cars embodying a slackless rotary dump drawbar of the present invention.

Referring now to FIG. 1 there is shown a pair of railway cars 10 and 11 connected by a slackless drawbar 12 embodying the structure of the present invention. The cars 10 and 11 are located in series with an unloading station 13 adjacent which there is provided a positioner arrangement or apparatus 14. The positioner apparatus serves to sequentially move individual cars connected in a train into the unloading station 13.

The positioner apparatus 14 is of substantially convention structure and includes generally a runway 16 parallel to railway car track 17 on which the cars 10 and 11 are located. A carriage 18 is positioned on the runway 16 for movement therealong. The carriage 18 is moved by cables 19 connected to a suitable source of power (not shown).

A pusher arm 21 is mounted on the carriage 18 for movement between an actively engaged position in the path of the connected cars 10 and 11 and an inoperative position clear of the cars. Connected to a free end of the pusher arm 21 is a head 22 or 23 which is engageable with the drawbar 12 for moving the train and a selected car into the unloading station 13 as more fully to be described hereinafter.

Figure 11:
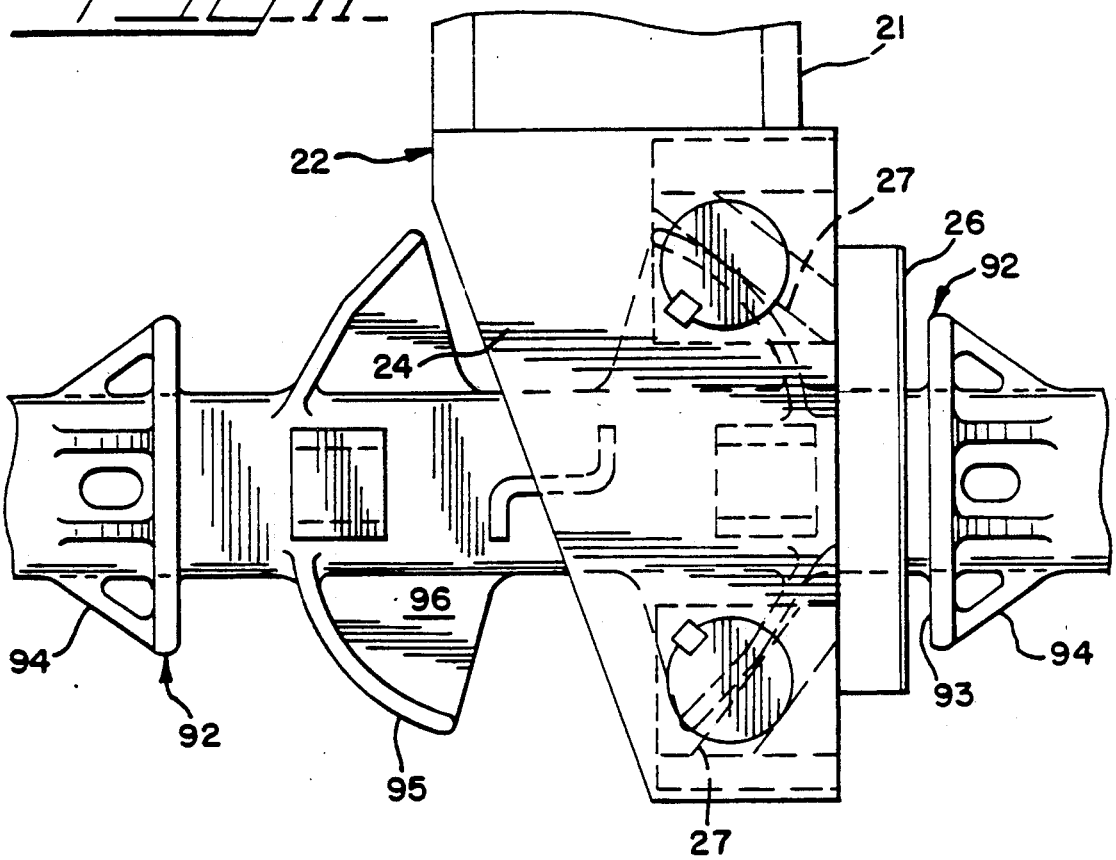
FIG. 11 is a fragmentary plan view of one form of pusher head for use with a positioner arrangement that normally uses a striker plate to move railway cars and shown with the slackless rotary dump drawbar system of the present invention.
Figure 12:
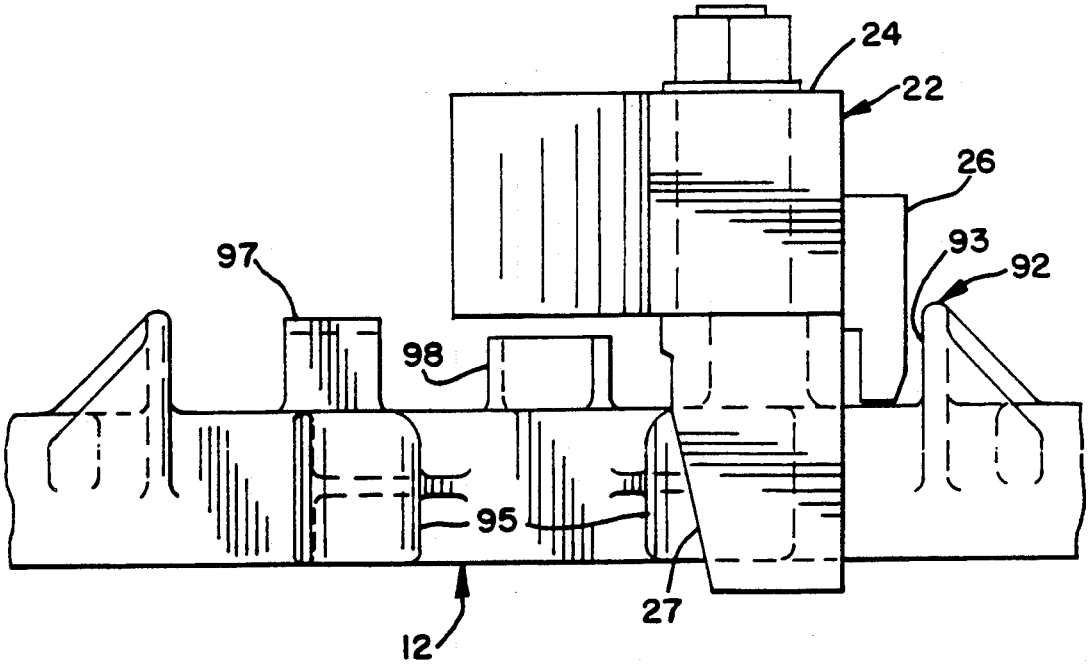
FIG. 12 is a side elevation view of the pusher head and slackless drawbar of FIG. 11.
Figure 13:
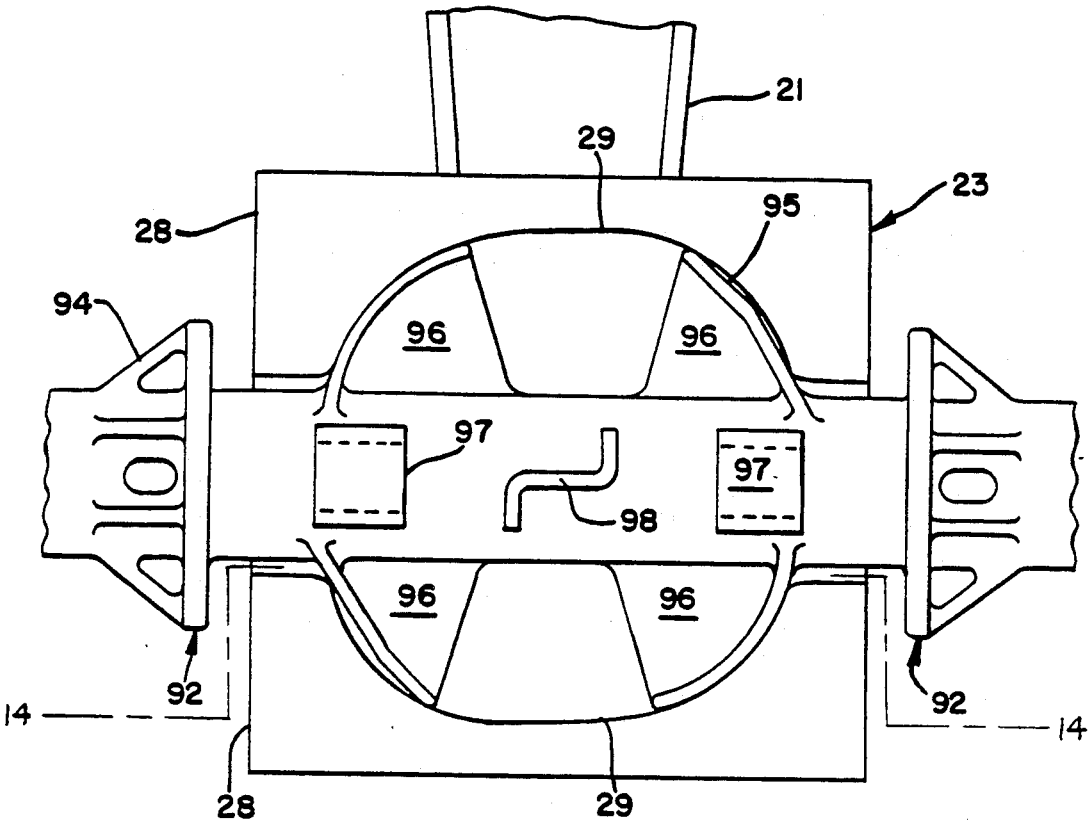
FIG. 13 is a fragmentary top plan view, with parts broken away, of another form of indexer pusher head shown with the slackless drawbar of the present invention.
Figure 14:
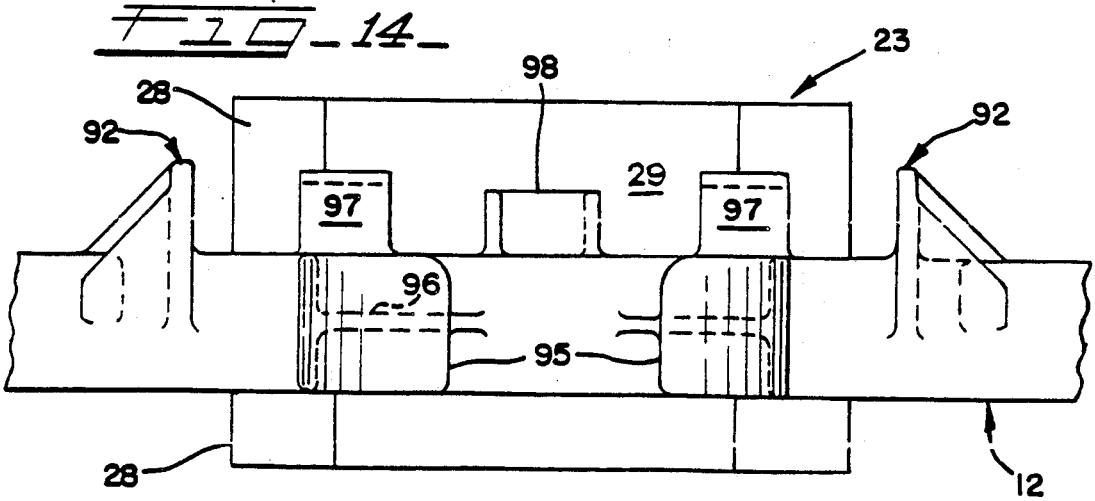
FIG. 14 is a side elevation view, taken at line 14—14 of the pusher head and slackless drawbar of FIG. 13.

The pusher arm head may be of the type as shown in FIGS. 11–12 wherein the head 22 is adapted to be engageable with an end of a rail car center sill or striker plate in a conventional manner (not shown); or a coupler pusher arm head 23 of the type shown in FIGS. 13 and 14 which embraces interlocked E and/or F coupler heads. As more fully to be explained hereinafter the drawbar 12 of the present invention is constructed in a manner such that the latter or preferably either of these pusher arm heads 22 or 23 may be used.

The pusher arm head 22 (FIGS. 11 and 12) includes a plate 24 fixed as by welding or the like to the end of the pusher arm 21. The plate 24 is provided with an upright wall 26 which is adapted to abut a striker casting (not shown) usually fixed to the end of a car center sill. Projecting downwardly from and attached to the plate 24 is a plurality of spaced tapered pusher arm pins 27. In connection with the use of the pusher arm head 22 with a conventional E or F coupler head, the shape of pusher arm head 22 is adapted so the tapered pusher arm pins 27 engage the knuckle and guard arm faces of an E or F coupler head (not shown) in one direction (for instance to stop car movement) and the upright wall 26 is in engagement with a striker plate (not shown) in an opposite direction (for instance to advance a car). When thus engaged the pusher arm head 22 is usually operative to push against a car striker plate, and thereby the train, when the carriage power source is energized, but may also be operated in the opposite direction against the coupler surfaces. When the car is indexed into the unloading station 13 the power is deenergized and the pusher arm head 22 is disengaged. The structure of this type of pusher arm head is more or less conventional and is manufactured by the Dravo-Wellman Co. of Cleveland, Ohio.

The pusher arm head 23 shown in FIG. 13 and 14 is manufactured by the Heyl & Patterson Company of Pittsburgh, Pa. The pusher arm head 23 includes a pair of movable jaws 28. The jaws 28 are hydraulically actuated to enclose interlocked coupler heads of the E and F type (not shown). To ensure firm engagement, each of the jaws 28 is formed with a concave surface 29 contoured to provide wall sections which abut against the coupler head surfaces on the knuckle and guard arm sides thereof to clamp the couplers therebetween. When the pusher head jaws 28 are in clamped relationship about interlocked coupler heads, the train is moved by the carriage 18 to locate the car to be unloaded at the unloading station 13.

Figure 2:
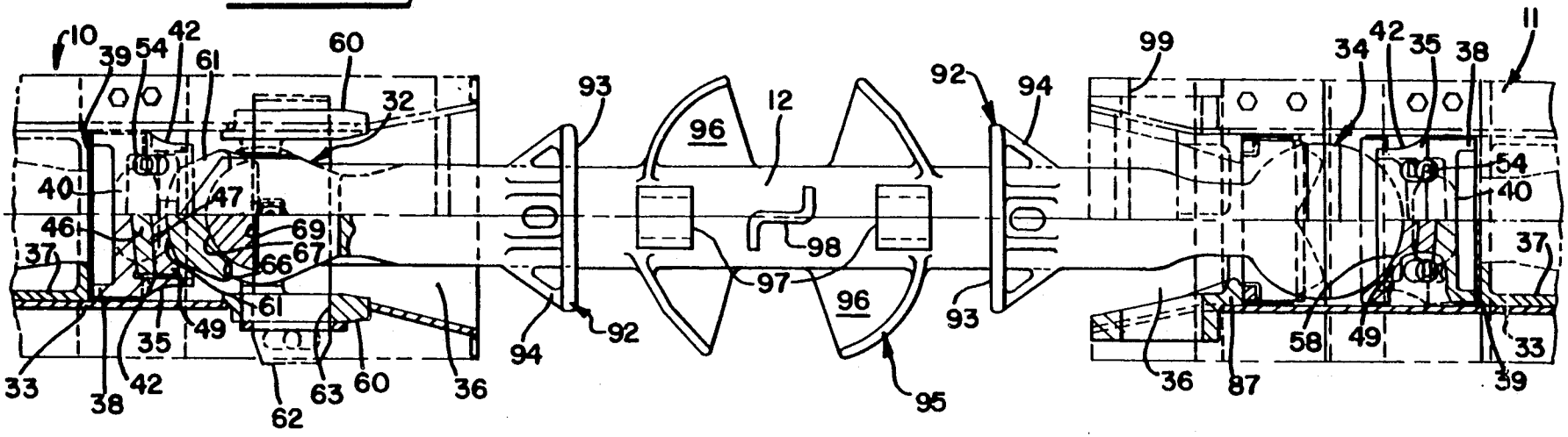
FIG. 2 is a top plan view of the slackless rotary dump drawbar system shown connected to the ends of two adjoining railway cars.
Figure 3:
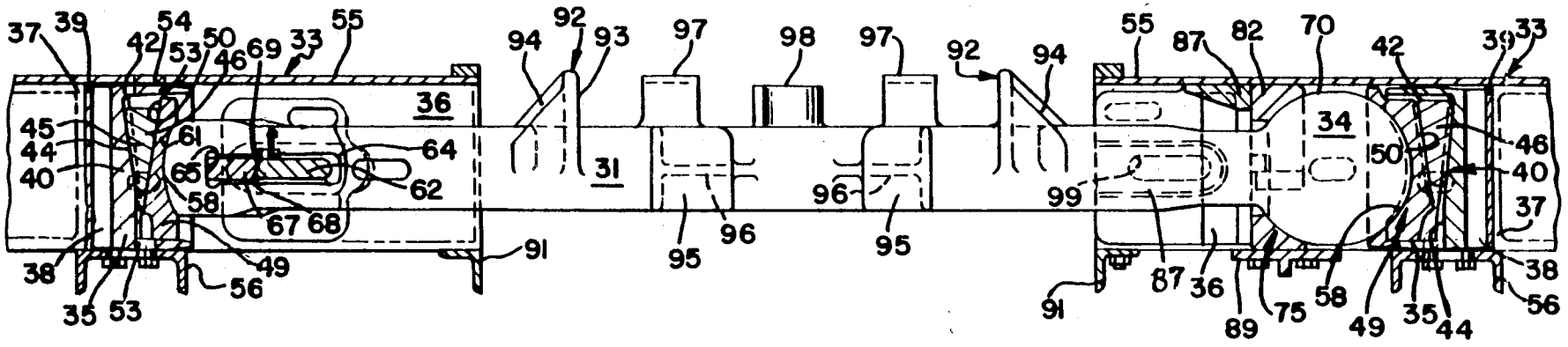
FIG. 3 is a side view of the slackless rotary dump drawbar system of FIG. 2.

The drawbar 12 of the present invention as shown in particular in FIGS. 2 and 3 is constructed to be operative with positioner apparatus having either of the above described head types.

The drawbar 12 is made from cast metal such as steel and includes a shank 31 on which there is provided a non-rotatable fixed end 32 (to the left side in FIGS. 2 and 3) securable to a center sill 33 of the car 10, and a rotatable end 34 (to the right side in FIGS. 2 and 3) received in the center sill 33 of an adjoining car 11. Each of the fixed end 32 and rotatable end 34 of the drawbar extends to pocket castings 35 and follower blocks 49 in the respective center sills 33. The respective follower blocks 49 differ slightly but otherwise the center sill and pocket casting parts are substantially identical and are best seen in the enlarged view of FIG. 3A.

The fixed (non-rotatable) end 32 is held in the center sill 33 of car 10 by a key 62 against a follower 49 within a pocket casting 35. The pocket casting 35 is received within a center sill opening 36 defined at its inboard end by rear stops 37. The rear stops 37 abut against side wall extensions 38 of the pocket casting 35. A shim 39 may be disposed between the rear stops 37 and pocket casting side wall extensions 38. The shim 39 may be replaced, as hereinafter described, with a thicker shim should wear require the pocket casting 35 to be spaced further from the rear stops 37.

Pocket casting 35 has a cup like cavity formed by an end wall 40 and an encircling skirt 42. Within the cavity the end wall 40 presents an inclined face 44 which is formed with a generally shallow V-shaped concavity (seen in FIG. 2).

Figure 3A:
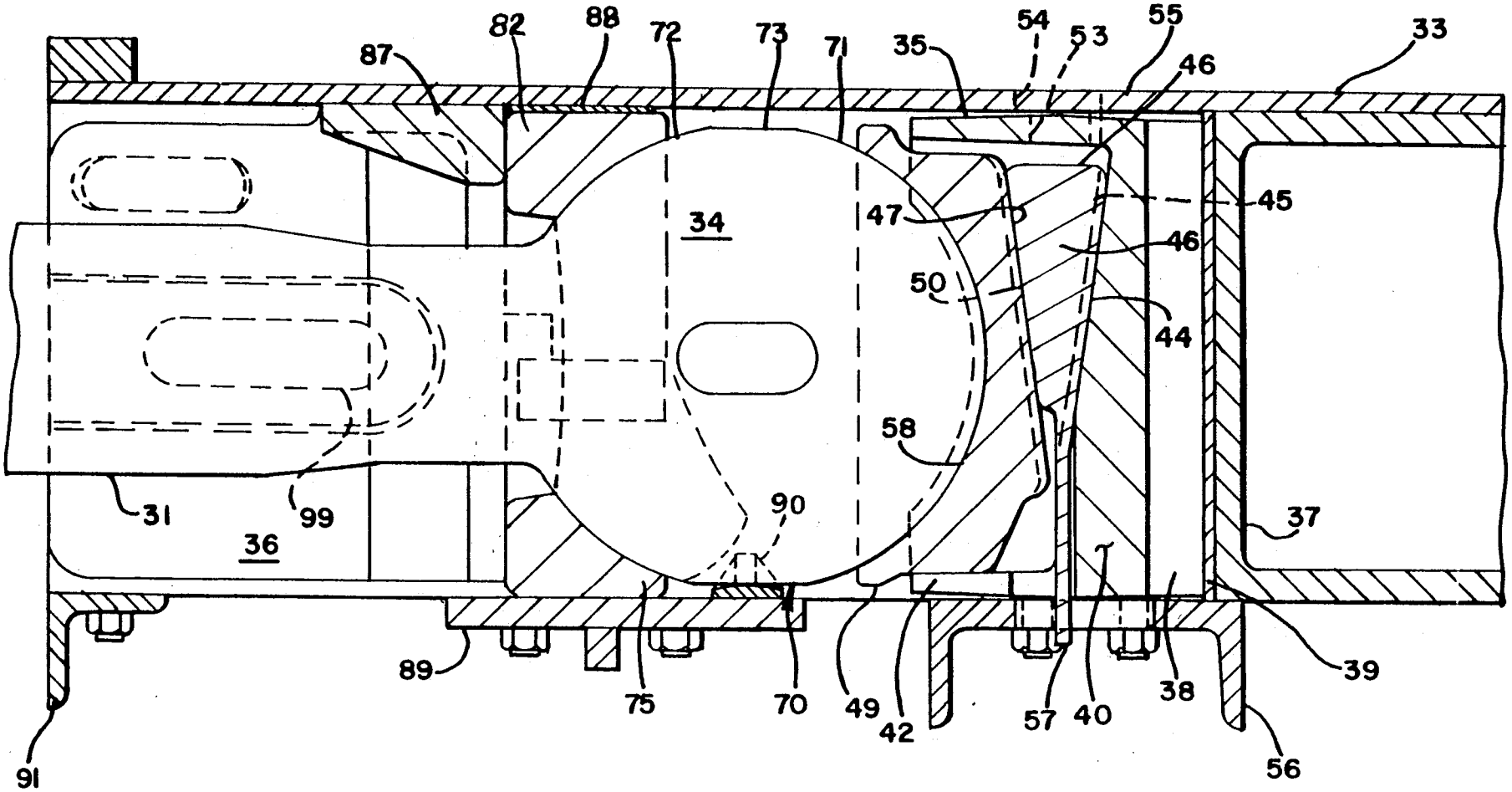
FIG. 3A is an enlarged view of the rotary portion of a drawbar system similar to FIG. 3 illustrating means to maintain alignment of the parts and having a preferred slack reducing wedge structure.

As best seen in FIG. 3A a wedge 46 is seated in the cavity and frictionally bears against the pocket casting face 44. Wedge 46 has an inboard inclined bearing or friction surface 45 which is convex so as to be complementary to the face 44. An outboard wedging surface 47 on wedge 46 is also formed as a shallow V-shaped concavity that bears against a follower block 49. The follower block 49 is formed with a complementary inboard wedging convex V-shaped face 50 which bears against the concave outboard surface 47 of wedge 46.

Figure 9:
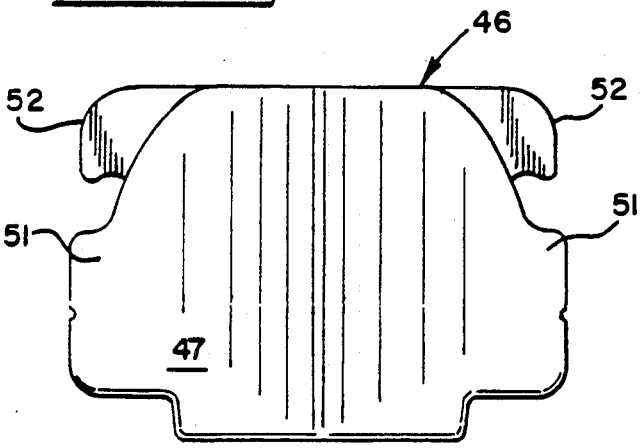
FIG. 9 is a front elevational view of one form of wedge used to maintain a slackless connection between the connected railway cars.
Figure 10:
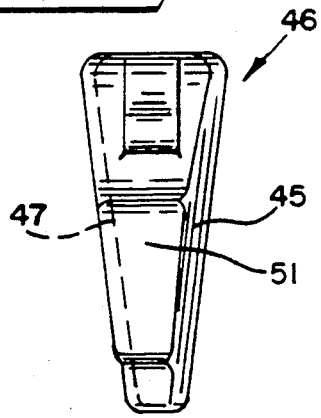
FIG. 10 is a side elevational view of the wedge shim shown in FIG. 9.

One embodiment of wedge 46, as shown in FIGS. 9 and 10, is provided with laterally projecting guiding tabs 51 to minimize lateral shifting thereof. Lifting or positioning lugs 52 of generally hook shape also project from wedge sides. Access to the lugs 52 and the wedge 46 is made possible by the provision of access openings or slots 53 formed in the skirt 42 of the pocket casting 35 and corresponding apertures 54 are provided in the top web 55 of center sill 33 and in a lower channel member 56 (which supports the pocket casting 35) thereby enabling insertion of a tool to engage lugs 52 of the wedge 46 without removing the pocket casting 35. The wedge may also be vertically positioned by inserting a tool through an opening or slot in the pocket casting and center sill side walls (not shown).

Another embodiment of wedge 46, as shown in FIG. 3A is provided with a depending tail piece 57 which extends downward through bottom openings in the pocket casting skirt 42 and in lower channel 56 and thereby facilitates vertical repositioning of the wedge.

The outboard face of the follower block 49 is formed with a spherical concave face 58 which receives a convex spherical butt 61 on fixed end 32 of the drawbar shank 31. Retaining the fixed end 32 within the sill pocket 36 is a key 62 which extends through slots 63 in sill side castings 60 and a key slot 64 in the shank 31.

The end of the key slot 64 is formed with a concave surface 65 concentric to the follower block spherical concave face 58 and convex spherical butt 61 of drawbar shank 31. Seated and bearing against the concave surface 65 is a complementary convex face 66 of a key bearing block 67. This facilitates horizontal angling of the drawbar 12 while the fixed end 32 is held by key 62. The bearing block 67 has a groove 68 of semicircular cross section along its edge opposite convex face 66. Seated within the groove 68 is a complementary convex edge 69 of the key 62. A resilient pad is disposed between the top of the slot 64 and top face of the key 62 to permit vertical angling of the drawbar 12 while maintaining the key 62 seated in the groove 68 of the bearing block 67. This facilitates vertical angling of the drawbar 12 on the key 62.

The rotatable end 34 of the drawbar 12 is received in a center sill opening 36 of the car 11. Within the center sill opening is a pocket casting 35, having wedge 46, and follower block 49 of structure similar to that described in connection with the stationary or fixed end 32 although it may extend outwardly of the pocket casting 35 to engage a larger portion of the rotatable end 34. A shim 39 may be disposed between rear stops 37 and pocket casting wall 38 as also described at the fixed end 32. Similar wedge access slots 53 and apertures 54 are also provided in the pocket casting 35 and the top web and side of the center sill.

The rotatable end 34 of drawbar 12 is formed as a ball generally 70 having two spherical portions 71, 72 generated from a common center disposed inwardly and outwardly, respectively, of the follower block 49, which portions are attached to a cylindrical barrel 73 of smaller diameter (to fit within the sill pocket 36). The outward spherical surface 71 engages the spherical concave face 58 on the follower block 49. Retaining the ball end 70 within the sill pocket 36 is a bottom pulling block segment 75 and an interlocking top pulling block segment 82 (shown in detail in FIGS. 4–8) which engage the inward spherical surface 72.

Figure 6:
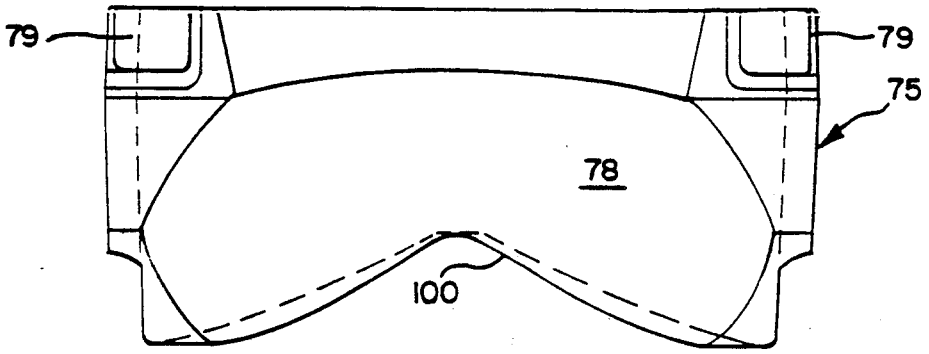
FIG. 6 is a top plan view of a lower pulling block segment.
Figure 7:
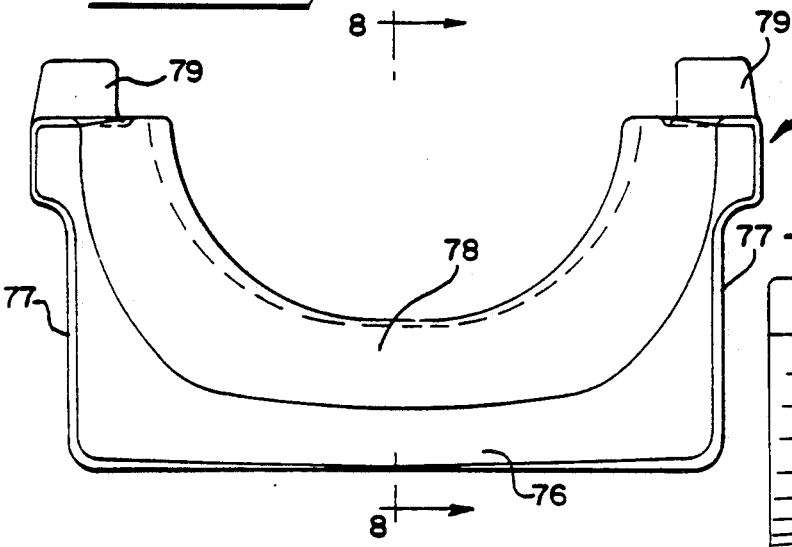
FIG. 7 is an elevational view of the lower pulling block segment of FIG. 6.
Figure 8:
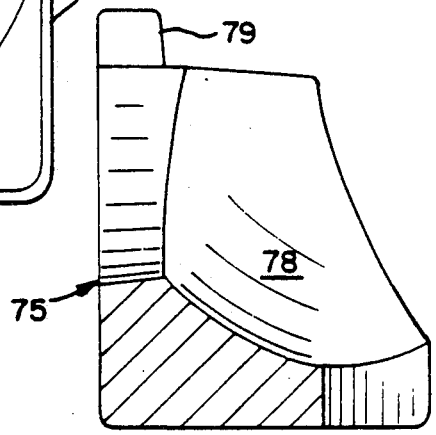
FIG. 8 is a section view of the lower pulling block taken at line 8—8 in FIG. 7.

The bottom pulling block 75 (as shown in FIGS. 6–8) is generally in the form of a semicircular ring provided with a base 76 and a pair of generally upstanding walls 77. The block segment 75 is formed with a concave part-spherical surface 78 which engages the inwardly disposed portion 72 of spherical ball 70. The base 76 of the lower pulling block 75 is provided with a generally "V" shaped notch 100 which reduces the lowermost bearing area of the concave surface 78. All spherical surfaces are concentric to lessen the resistance to drawbar angling during curve negotiation and the rotary dump operation.

A pair of lugs 79 project from the top of the block 75 and are seated in notches or recesses 83 in the upper pulling block segment 82.

Figure 4:
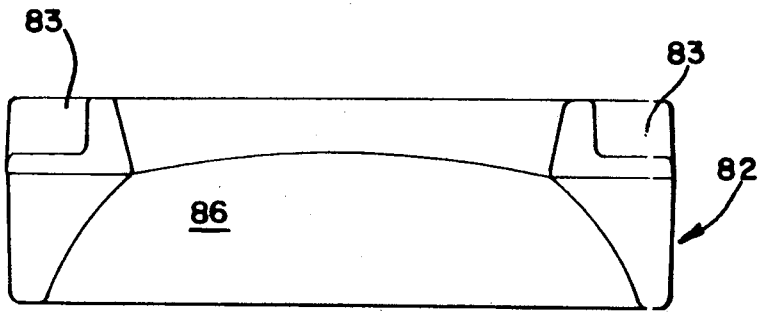
FIG. 4 is a bottom plan view of an upper pulling block segment of the slackless rotary dump drawbar system of FIG. 2.
Figure 5:
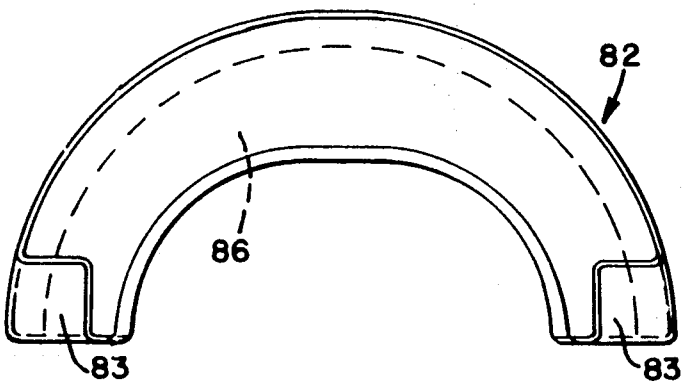
FIG. 5 is an elevational view of the upper pulling block segment of FIG. 4.

An upper pulling block segment 82 (as shown in FIGS. 4 and 5) is also in the general form of a semicircular ring of which the inner surface is formed as a part-spherical concave surface 86. The concave surface 86 bears against the inwardly disposed portion 72 of ball 70 and coacts with the bottom pulling block concave surface 78 to embrace the ball 70. The upper and lower pulling blocks 82, 75 are formed with complementary semicircular openings through which the drawbar shank extends. It is to be noted that the part-spherical surfaces 78 and 86 are non-symmetrical with the concave surface 78 of the lower pulling block 75 being notably larger.

Restraining the pulling blocks 75 and 82 against lengthwise movement out of the sill opening 36 is front stop 87. A removable cross plate member 89 is fastened by bolts or the like, across the bottom flanges of the center sill 33 to support the pulling blocks 75 (and 82) within the sill opening 36. Channels 56 are also removably secured by bolts or the like, across the sill 33 to support the pocket casting 35 and the wedge 46 for both the fixed end 32 of the drawbar as well as the rotatable end 34.

Two important and preferred features of the construction receiving the drawbar rotatable end 34 are a horizontal shim 88 positioned between the upper pulling block 82 and the top of sill 33, and a cradle 90 on cross plate 89 to support the drawbar end ball 70. Both features are illustrated in FIG. 3A and provide means to maintain the pulling blocks 75, 82, ball 70 and follower 49 in proper orientation. The centers for generating the arcuate surfaces should be horizontally aligned; however when draft (pulling) loads are applied to the drawbar, the ball 70 tends to rise across the lower pulling block 75 and spread the pulling blocks 75, 82 apart. Should that occur the aforementioned centers for pulling blocks 75, 82 would separate vertically and lose concentricity with the abutting ball surface portion 72. The result would be to increase resistance to angling and rotation of the drawbar. Additionally, the ball 70 would move so as to cause wedge 46 to drop and reposition the follower 46 thereby reducing the available wedge and follower adjustment for wear compensation. The cradle 90 serves to support the drawbar ball 70 at the proper level for alignment to maintain concentricity with the follower 49 and pulling blocks 75, 82 during or immediately after the system is unloaded such as the brief transition from buff to draft loading (or vice versa) or when the car is rotated and the wedge slightly retracts or during partial disassembly. Preferably the cradle has an arcuate surface that is concave to receive the barrel 73 of ball 70.

Should a slack adjusting wedge 46 or adjacent parts become worn to the point that the wedge no longer functions to eliminate slack, the wedge 46 may be lifted by extending a tool through openings 53 and apertures 54 into engagement with the wedge lugs 52. Another method is inserting a tool through the bottom openings in the pocket casting skirt 47 and lower channel 56 and applying a vertical force to the bottom of wedge shim 46 or by pushing upward on a wedge tail piece 57 if so provided. This will allow the worn parts to be spaced further from the rear stops 37 and a shim 39 disposed between rear stops 37 and pocket casting wall 38, or shim 39 replaced with a thicker shim to compensate for dimensional changes in worn but usable parts. Similarly if it becomes necessary to disconnect the drawbar 12, that may be accomplished at either or both ends by lifting the wedge 46 and removing either, or both, the key 62 and the pulling blocks 75,82 (by first removing cross plate 89).

The drawbar 12 is shown connected between two cars 10 and 11, each having center sills 33 terminating in a removable lightweight angle iron reinforcement 91 rather than a striker casting as has been common heretofore. This angle iron reinforced end does not extend the same distance beyond the car and center sill as would a striker casting. Thus the indexing pusher arm heads 22 of the type which employed the striker casting surface to push a car would normally be unsuitable.

In accordance with the present invention the drawbar 12 may be and preferably is provided with a mock striker casting appurtenance 92 spaced from each end of the drawbar shank 31 and extending radially therefrom. As shown in FIGS. 2, 3, 11 and 12, the striker plate appurtenances 92 formed into bearing surfaces 93 which partly encircle the top portion of shank 31 and are located and positioned above and along side the drawbar shank by gussets 94 at a distance from the end approximately equal to the normal distance between an end casting and striker plate on a conventional railcar.

The drawbar 12 must be provided with mock coupler head appurtenances 95 that also extend substantially radially and are lengthwise spaced arcuate wall sections 95 of vertical dimension which project from the sides of the drawbar shanks 31. The arcuate wall sections 95 are secured to the shank 31 by horizontal web-like braces 96. Coupler appurtenances 95 are preferably integrally cast with the shank 31, and are shaped or curved to simulate knuckle sides and guard arm surfaces of interlocked E and/or F coupler heads. Spaced inverted U-shaped projections 97 on the drawbar tops are provided to simulate the horn of the couplers.

When rail cars 10 and 11 are interconnected by the drawbar 12 of the present invention and positioned at the indexing station and the positioner apparatus 14 is provided with the pusher arm head 22 (FIGS. 11 and 12), the pusher arm 21 is first lowered so that the upstanding pusher arm head wall 26 bears against the appurtenances 92 and the downward projecting tapered pins 27 engage the arcuate vertical wall sections 95—95 so that the pusher arm head 22 is positioned between these surfaces. Thus normal movement of the carriage 18 toward the unloading station 13 is transmitted to the train by engagement of the upright wall 26 with the bearing surface 93 and the train is retarded by engagement of the pins 27 with the arcuate wall sections 95; however, it would also be possible to reverse the head 22 so as to utilize pins 27 to push against the opposite set of arcuate wall sections 95.

Referring now to FIGS. 13 and 14 there is shown the other pusher head 23 which as heretofore described includes two longitudinally movable jaws 28 formed with concave walls 29. As shown when the jaws 28 are closed the opposing pairs of coupler arcuate wall surfaces 95 which simulate interlocked E and F coupler heads are tightly embraced and the concave surface walls 29 of the upper jaw also grip the horn simulating projection 97 so that adequate gripping of the drawbar is achieved. An upstanding plate 98 centrally projecting from the shank 31 simulates the top of a coupler knuckle. According to the particular indexing mechanism encountered either horn projections 97 or plate 98 may serve to contact a trigger on the jaws to actuate the repositioning of railcars. Thus movement of the carriage 18 may be transmitted to the train to position the car 11 into the unloading station 18.

If for some reason, such as a broken or damaged drawbar, a car must be moved to a repair point, slots 63 have been provided in sill side casting 60 and front stop 87 may similarly be provided with key slots 99 (FIGS. 2 and 3A). Thus AAR standard "E" rigid shank type couplers can then be applied, after drawbar removal, into each car end. The couplers are then secured by inserting a draft key 62 through slots 63 and 99 respectively, in each car for moving the cars individually or coupled to the nearest repair point.

The foregoing detailed description is directed to the best mode for practicing the invention and further variations and modifications may be made without departing from the spirit and scope of the invention which is defined in the following claims.

What is claimed is:

1. A railcar slackless rotary drawbar system comprising:

a drawbar having an elongated shank and at least one end rotatably retained within the center sill of a railcar;

a ball at said one end having a first spherical portion adjacent said shank and a second spherical portion outward thereof;

a crossplate connected across a bottom of said center sill;

a lower pulling block resting on said crossplate, said lower pulling block having a concave surface substantially concentric with said first spherical portion of said ball;

an upper pulling block resting on said lower pulling block, said upper pulling block having a concave surface substantially concentric with said first spherical portion of said ball;

a follower block held within said center sill, said follower block having a concave surface substantially concentric with said second spherical portion of said ball;

a wedge disposed against said follower block whereby to urge together the respective concentric surfaces of said follower block, ball and pulling blocks;

aligning means for maintaining the orientation of said ball with said pulling blocks and said follower block; and said ball including a barrel portion between said first and second spherical portions which rests upon said aligning means.

2. The drawbar system of claim 1 wherein said aligning means includes a shim between said upper pulling block and said center sill whereby to prevent separation of said pulling blocks.

3. The drawbar system of claim 1 wherein said aligning means includes a cradle located on said crossplate to support said ball.

4. The drawbar system of claim 1 including appurtenance means projecting radially from said drawbar shank and spaced from said end for simulating coupler surfaces whereby said drawbar is capable for use with and being engaged by railway car indexer means adapted to engage conventional coupler surfaces for indexing cars connected thereby into an unloading station.

5. The drawbar as defined in claim 4 wherein a striker casting appurtenance is located inwardly of each end of said shank.

6. The drawbar as defined in claim 5 wherein said striker casting appurtenance partly encircles said shank at an upper portion thereof.

7. The invention as defined in claim 4 wherein said coupler surface appurtenances comprise arcuate walls projecting from opposite sides of said shank and curved toward an end thereon.

8. The invention as defined in claim 7 wherein said arcuate walls are arranged in pairs with one of said pairs being concave toward one end of said shank and the other of said pairs being concave toward the opposite end of said shank whereby to simulate knuckle and guard arm configurations of standard couplers.

9. The invention as defined in claim 8 wherein said appurtenances additionally include upward projections on the upper portion of said shank above said arcuate walls whereby to simulate at least one of the horn and knuckle top surfaces of interlocked couplers.

10. A railway drawbar system for connecting two railway cars having a car sill pocket defined by a top web and depending side walls at the end of center sills of each car, said drawbar system comprising:

a drawbar of a defined shape having an elongated shank, ends on said shank for being retained in said car sill pockets, one of said ends being a ball shaped configuration;

a cup shaped pocket casting in one sill pocket receiving an outer surface of said ball shaped configuration;

a lower pulling block and a top pulling block having concave surfaces engaging and encircling an inner part of said ball shaped configuration disposed in said one sill pocket whereby said ball shaped configuration is rotatable about its axis within said one sill pocket;

aligning means for maintaining said ball shaped configuration and said pulling block properly oriented within said one sill pocket; and appurtenance means projecting radially from said drawbar shank and spaced from said ends for simulating coupler surfaces whereby said drawbar system is capable for use with and being engaged by railway car indexer means adapted to engage conventional coupler surfaces for indexing cars connected thereby into an unloading station.

11. The invention as defined in claim 10 wherein said lower pulling block and said top pulling block are each in the general form of semicircular rings one block having lugs which are received in recesses on the other of said pulling blocks.

12. The invention as defined in claim 11 wherein each of said pulling blocks has part-spherical surfaces which engage a spherical surface of said ball shaped configuration, the lower pulling block has a base with a V-shape or notch in the lowermost portion of said base and said aligning means includes a horizontal shim between said upper pulling block and said top web.

13. A railway slackless rotary drawbar system for connecting two railway cars each having a car sill pocket defined by a top web and depending side walls at the ends of center sills of each car, said drawbar system comprising:

a drawbar of a defined shape having an elongated shank, a spherical sector on one end of said shank received in the sill of a first railway car, a ball on the other end of said shank received in the sill of a second railway car, a cup shaped pocket casting in each of the sill pockets and receiving respective said ends of said shank, follower blocks in each of said pocket castings, said follower blocks each having a concave surface engageable with respective ends of said spherical sector and said ball shaped configuration, a wedge disposed within each said pocket casting between said follower block and a vertical pocket casting wall in face to face engagement with at least one included wall on one of said follower block and said pocket casting wall, key means extending through said sill of said first railway car and said shank end having said spherical sector for connecting said drawbar against rotation within said sill, a cross plate connected between said sill side walls of said second railway car;

a lower pulling block and a top pulling block having concave surfaces engaging said ball end disposed in said second railcar sill whereby said ball end is rotatable about its axis within the sill pocket, said lower pulling lock supported on said cross plate and a horizontal shim between said top pulling block and said sill top web whereby to prevent separation of said lower and top pulling blocks, stop means retaining said pulling block against lengthwise movement out of said sill pocket, a cradle located on said cross plate to support said ball; and appurtenance means projecting from said drawbar shank for simulating striker casting surfaces and coupler head surfaces whereby said slackless drawbar system is capable for use with railway car indexer means adapted to engage conventional striker castings and coupler heads for indexing said cars into an unloading station.

14. The invention as defined in claim 13 wherein said striker casting appurtenances comprises wall sections fixed to said shank to project vertically thereover.

15. The invention as defined in claim 13 wherein said coupler head surface appurtenances comprise upstanding arcuate walls projecting from the sides of said shank.

16. The invention as defined in claim 15 wherein said arcuate walls project from opposite sides of said shank.

17. The invention as defined in claim 16 wherein said upstanding arcuate walls are arranged in pairs with one of said pairs being concave toward one end of said shank and the other of said pairs being concave toward the opposite end of said shank simulating knuckle and guard arm configurations of standard couplers.

18. The invention as defined in claim 15 wherein said appurtenances include a pair of lengthwise upwardly projecting spaced walls simulating the horn surfaces of interlocked couplers.

19. The invention as defined in claim 13 wherein said appurtenances include a surface projecting above said shank for simulating the upper surface of interlocked knuckles of couplers.

20. The invention as defined in claim 13 wherein said lower pulling block and said top pulling block are each in the general form of semicircular rings one block having lugs which are received in recesses on the other of said pulling blocks.

21. The invention as defined in claim 20 wherein each of said pulling blocks has part-spherical surfaces which engage a spherical surface of said ball.

22. The invention as defined in claim 21 wherein said lower pulling block has a part-spherical surface, to engage a spherical surface of said ball, which part-spherical surface is larger than the part-spherical surface of the upper pulling block and where the part spherical surface is reduced at the lowermost portion thereof by a notch formed in the pulling block.

* * * * *